US005156458A

United States Patent [19]

Hemrajani et al.

[11] Patent Number: 5,156,458

[45] Date of Patent: Oct. 20, 1992

[54] SURGE DRUM INTERNALS DESIGN FOR DAMPING OF SINUSOIDAL VARIATIONS IN THE FEED CONCENTRATION

[75] Inventors: Ramesh R. Hemrajani, Millington; Peter R. Ponzi, Randolph, both of N.J.

[73] Assignee: Exxon Research and Engineering Company, Florham Park, N.J.

[21] Appl. No.: 322,378

[22] Filed: Mar. 13, 1989

Related U.S. Application Data

[63] Continuation of Ser. No. 121,158, Nov. 16, 1987.

[51] Int. Cl.[5] ..... B01F 5/06

[52] U.S. Cl. ..... 366/336; 366/340; 48/189.4; 261/123

[58] Field of Search ..... 366/336, 337, 338, 339, 366/340; 261/123; 138/42, 44; 48/180.1, 189.4; 585/734, 738, 955

[56] References Cited

U.S. PATENT DOCUMENTS

| | | | |
|---|---|---|---|
| 1,093,385 | 4/1914 | Clemmer | 138/42 X |
| 1,491,049 | 4/1924 | Lichtenthaeler | 366/340 |
| 2,069,714 | 2/1937 | Getchell | 138/42 |
| 2,088,591 | 8/1937 | Ferkel | 366/336 X |
| 2,740,616 | 4/1956 | Walden | 366/336 |
| 4,210,771 | 7/1980 | Holcombe | 585/738 X |
| 4,233,269 | 11/1980 | Kaye et al. | 261/123 X |
| 4,313,680 | 2/1982 | Honnen | 366/340 X |

*Primary Examiner*—Harvey C. Hornsby
*Attorney, Agent, or Firm*—Joseph J. Dvorak

[57] ABSTRACT

The present invention is directed toward the dampening of concentration variations in fluid streams, especially concentration variations that are substantially sinusoidal, by subjecting such streams to a plurality of back-mixing steps whereby such concentration variations are reduced.

In one embodiment of the present invention, there is provided a surge drum that is divided into a predetermined number of mixing stages, each of which is provided with means to create a fluid jet stream at substantially the inlet of the mixing stage and baffle means positioned with respect to the inlet jet for reversing the flow of the jet.

5 Claims, 1 Drawing Sheet

SURGE DRUM INTERNALS DESIGN FOR DAMPING OF SINUSOIDAL VARIATIONS IN THE FEED CONCENTRATION

This is a continuation of application Ser. No. 121,158, filed Nov. 16, 1987.

FIELD OF THE INVENTION

The present invention relates to improvements in mixing fluid compositions such as gas and liquid streams. More particularly, the present invention relates to dampening of the concentration variations in fluid streams obtained from adsorption/desorption processes.

BACKGROUND OF THE INVENTION

The need to adequately mix fluids in various industrial processes is well known. Indeed, numerous reactors have been designed to uniformly distribute liquid and gaseous reactants in a reactor vessel. U.S. Pat. No. 1,491,049, for example, discloses a mixer for liquids which has a number of horizontally disposed plates in the vessel for dividing and recombining the fluid streams in the reactor to promote mixing.

U.S. Pat. No. 4,233,269 discloses a fluid flow distributor for mixing and distributing gases and liquids over the cross-section of a reactor vessel having an upward fluid flow path.

U.S. Pat. No. 4,313,680 discloses a reactor for mixing fluid components in which the reactor contains flow deflecting elements to divide and direct a body of fluid flow at an angle of approximately ninety degrees from the central axis of the reaction chamber.

From the foregoing examples, it is readily apparent that thought has been given to provide means for achieving adequate mixing of fluid streams in reactor vessels. Consideration has not been given, however, to the mixing of product streams emanating from these process vessels.

In commercial processes, the product streams emanating from these reactor vessels must be treated downstream in heat exchangers, separators, and similar process equipment. For example, in the isomerization of normal hydrocarbons, the product emanating from the isomerization reactor contains a mixture of iso-, cyclic and unconverted normal hydrocarbons. This stream is passed through an adsorber to adsorb unconverted normal hydrocarbons. The adsorbed normal hydrocarbons are then desorbed during a desorption cycle using hydrogen gas. The normal hydrocarbons that are desorbed during the desorption cycle are then recycled back to the isomerization reactor. Some of the hydrogen which is used during the desorption cycle is adsorbed by the adsorbent bed. Consequently, when the mixture of iso-, cyclic and unconverted normal hydrocarbons are sent through the adsorber during the adsorption cycles, the hydrogen that had been previously adsorbed during the desorption cycle gets entrained with the iso- and cyclic hydrocarbons, which causes sinusoidal variations in the product concentration. Due to these cyclic concentration variations, the molecular weight and enthalpy of the stream of iso- and cyclic hydrocarbons changes considerably, which results in drastic swings in the heat duty requirements of a downstream heat exchanger. In addition, furnaces used to heat adsorber feed are oversized and higher heat input is needed to overcome reduced heat recovery. This, of course, necessitates significant capital equipment and utility costs. Therefore, there remains a need for providing means for inhibiting cyclic concentration variations in gas and liquid streams by providing homogeneous fluid streams for reliable downstream processing operations.

SUMMARY OF THE INVENTION

It has now been discovered, and this represents an object of the present invention, that fluid streams having sinusoidal variations in concentration can have such variations dampened by means of a surge drum having a plurality of backmixing stages, thereby minimizing the disadvantages associated with concentration variations in the fluid stream. Thus, in its simplest sense, the present invention is directed toward the dampening of concentration variations in fluid streams, especially concentration variations that are substantially sinusoidal, by subjecting such streams to a plurality of backmixing steps whereby such concentration variations are reduced.

In one embodiment of the present invention, there is provided a surge drum that is divided into a predetermined number of mixing stages, each of which is provided with means to create a fluid jet stream at substantially the inlet of the mixing stage and baffle means positioned with respect to the inlet jet for reversing the flow of the jet.

Another embodiment of the present invention is directed toward improvement in processes involving adsorption and desorption of fluids wherein an effluent fluid stream is obtained for subsequent processing that has concentration variations. In this embodiment the effluent stream, prior to subsequent processing, is subjected to backmixing in a surge drum whereby concentration variations are reduced.

DETAILED DESCRIPTION OF THE INVENTION

As will be readily appreciated, cyclic concentration variations in gas and liquid streams are caused by process changes, inadequate blending of different streams, or the cyclic nature of upstream operations such as adsorption and desorption operations. Homogenization of such streams is generally desirable for reliable downstream operations and consistent product quality. Thus, for example, in the isomerization of normal hydrocarbons, the product stream emanating from the isomerization reactor consists of a mixture of iso-, cyclic and unconverted normal hydrocarbons. This product stream is passed first through an adsorber to adsorb unconverted normal hydrocarbons. The adsorbed unconverted normal hydrocarbons are then desorbed by use of hydrogen gas. The normal hydrocarbons recovered in this way, of course, are recycled back to the isomerization reactor. During the desorption of the normal hydrocarbons, some of the hydrogen gas used in the desorption step is in fact adsorbed on the adsorbent. Thus, during the subsequent adsorption step, when the mixture of iso-, cyclic and unconverted normal hydrocarbons is sent to the adsorber, some of the adsorbed hydrogen is desorbed and entrained in the iso- and cyclic hydrocarbons exiting the adsorber during the adsorption cycle. This results in sinusoidal variations in the product concentration. The product is then sent to a heat exchanger for heat recovery. Because of the sinusoidal variations in the product concentration, the heat exchanger is oversized. This results in a significant capital expense which can be significantly reduced by interposing the surge drum of the present invention between the adsorber and the heat exchanger.

Figure 1:
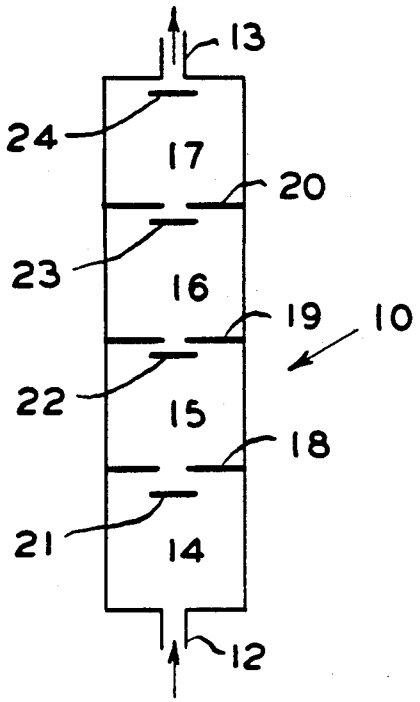
FIG. 1 is a schematic illustration of a four stage surge drum according to the present invention.

The surge drum of the present invention comprises a container that is divided into a predetermined number of mixing stages. As is shown in FIG. 1, the surge drum 10 includes a cylindrical housing 11 having an inlet 12 and an outlet 13 through which a fluid stream flows into and out of the drum. In the embodiment shown in FIG. 1, the drum is divided into four mixing stages 14, 15, 16 and 17, respectively, by means of horizontally disposed plates 18, 19 and 20. Plates 18, 19 and 20 each have a central opening, the diameter of which is substantially equal to the diameter of inlet pipe 12. Thus, inlet pipe 12 and plates 18, 19 and 20 serve to create a jet of fluid stream entering into their associated mixing stage. In other words, inlet pipe 12 serves to provide a jet stream of fluid for introduction into stage 14 and the opening in horizontal plate 18 provides a means for creating a jet stream of fluid entering into mixing zone 15, and so forth. As can be seen in FIG. 1, the surge drum 10 is provided with a plurality of baffle means 21, 22, 23 and 24. Each of these baffle means are positioned with respect to the inlet to reverse the flow of the inlet jet of fluid and to provide for maximum backmixing within the mixing stage.

Figure 2:
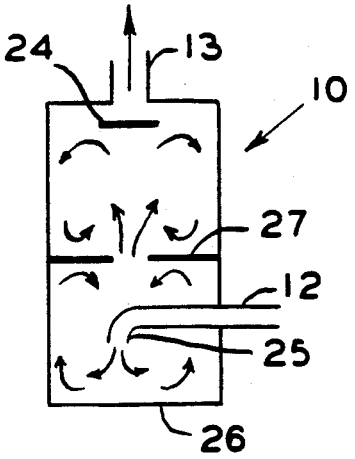
FIG. 2 is a schematic illustration of an alternate means for introducing a fluid stream into the first stage of a surge drum of the present invention.

In the embodiment shown in FIG. 2, an inlet nozzle 25 is positioned so as to discharge fluid in a downward direction. (The flow of fluid is shown by the arrows.) The bottom 26 of the surge drum housing 11 in this instance serves as the baffle means for reversing the flow of inlet jet fluid. Subsequent stages in the vessel, however, are separated by means of horizontally disposed plates such as plate 27 having a central opening therein, which has a diameter substantially the same as the diameter of the nozzle 25 of inlet pipe 12. Also, baffle means, such as baffle 24, are positioned to reverse the flow of the inlet jet of fluid to provide maximum backmixing.

As indicated, the surge drum of the present invention is divided into a predetermined number of mixing stages. The number of mixing stages, N, required for optimal dampening of streams having sinusoidal or nearly sinusoidal concentration variations is equal to:

$$\frac{\tau\omega}{1.98}$$

where $\tau$ is total residence time and $\omega$ is frequency of the feed concentration variation. The ratio of outlet to inlet concentration variation amplitudes for N optimum stages is given by:

$$\left(1+\left[\frac{\tau\omega}{N}\right]^2\right)^{-N/2}$$

Thus, an optimum surge drum design for one hundred seconds residence time and a 0.08 $sec^{-1}$ frequence of the inlet concentration variation would consist of four mixed stages such as shown in FIG. 1.

Figure 3:
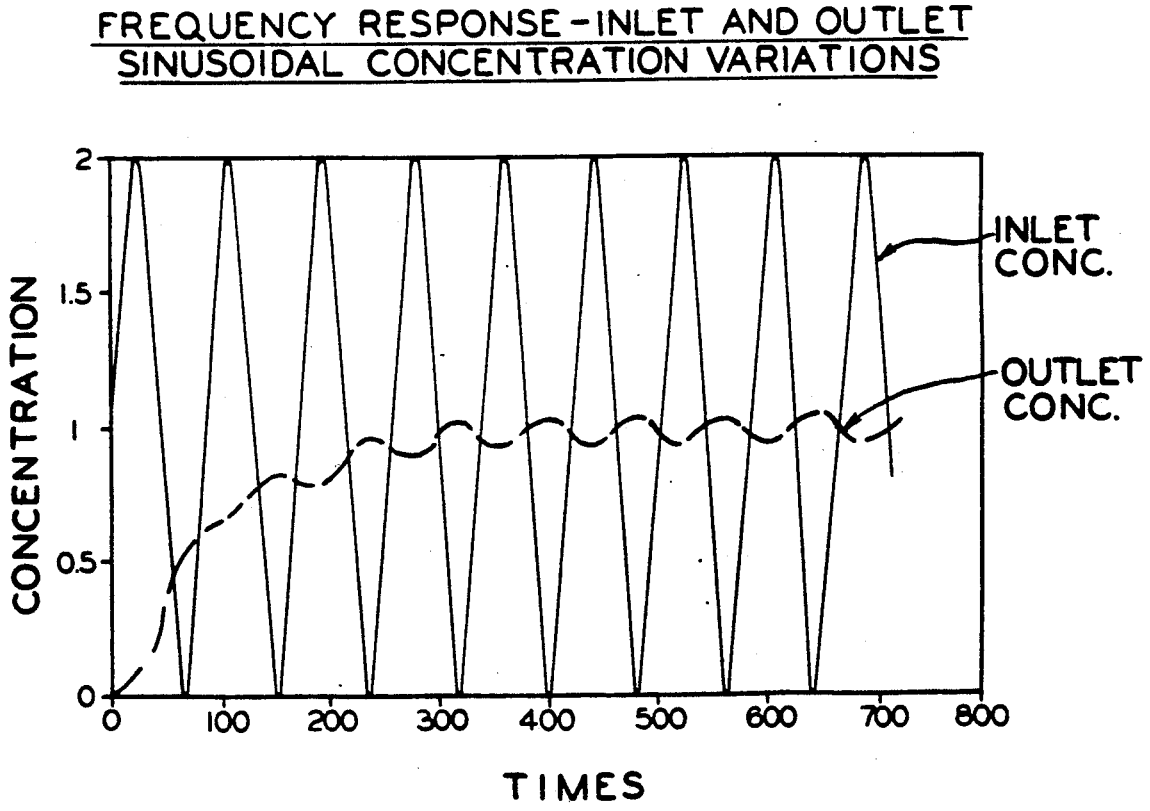
FIG. 3 is a graph illustrating the benefits of the invention.

In FIG. 3, inlet and outlet concentration variations are plotted for a surge drum having the parameters set forth in Table 1.

TABLE 1

| Surge Drum Conditions Used in the Backmixing Estimate | |
|---|---|
| Drum Diameter = | 10 ft |
| Drum Height = | 20 ft |
| Gas Feed Rate = | 15.6 $ft^3$/sec |
| Gas Density = | 1.3 lbs/$ft^3$ |
| Gas Viscosity = | 0.013 cp |
| Mixing Stages = | 2 |
| Donut Hole Diameter = | 6 in. |
| Disk Diameter = | 4 ft |
| Disk Location = | 2 ft below the outlet |
| Outlet Diameter = | 6 in. |
| Inlet Concentration | |
| amplitude = | 30 mole% |
| frequency = | 0.075 |

Indeed, the ratio of outlet to inlet amplitude is calculated by flow field computations to be 0.54 which compares well with a theoretical ratio of 0.47 for two well-mixed stages.

As explained in the specific embodiments above, the surge drum of the present invention is particularly suitable for use in processes in which the product streams have cyclic concentration variations that are sinusoidal or nearly sinusoidal and homogenization of such streams is generally desirable. Thus, although specific embodiments of the invention have been described in detail, the invention is not to be limited to any such embodiments but rather by the following claims.

What is claimed is:

1. An apparatus for reducing the amplitude of sinusoidal concentration variations in a stream of fluid comprising:

a housing through which a stream of fluid flows, said housing having an inlet and an outlet for the introduction and removal of fluid flowing through the housing;

plate means in said housing across the flow path of fluid dividing said apparatus into a predetermined number of back-mixing stages equal to $\tau\omega/1.98$ where $\tau$ is the total residence time of fluid flowing through the apparatus and $\omega$ is the frequence of the concentration variation in said stream of fluid, each of said plate means having an opening therein permitting a stream of fluid to flow into the next mixing stage, said opening being a central opening, the diameter of which is substantially equal to the diameter of the inlet in the housing;

a baffle means for each plate means positioned with respect to the opening in said plate means whereby the flow of the stream of fluid flowing through said opening is reversed so as to promote back-mixing of said stream whereby the amplitude of the variation in concentration of the fluid stream removed from said apparatus is less than that introduced into said apparatus.

2. The apparats of claim 1 wherein said housing is cylindrical.

3. In processes involving adsorption and desorption of fluids wherein an effluent stream is obtained for subsequent processing that has concentration variations, the improvement comprising:

flowing said effluent stream prior to subsequent processing through a surge drum having a predetermined number of mixing stages therein;

promoting the backmixing of the effluent stream in each mixing stage;

removing a fluid stream from said surge drum having reduced concentration variations; and sending said stream with reduced concentration variations for subsequent processing.

4. The method of claim 3 wherein said predetermined number of mixing stages is equal to:

$$\frac{\tau\omega}{1.98}$$

where $\tau$ is the total residence time of fluid flowing through the drum and $\omega$ is the frequency of the concentration variation of the feed.

5. A surge drum for dampening concentration variations in a fluid stream comprising:

a housing having a first end and a second end;

an inlet at said first end for introducing a fluid sfream having concentration variations for flow through said housing;

an outlet at said second end for removal of said fluid stream from said housing with said concentration variations dampened;

plate means for dividing said drum into a predetermined number of each back-mixing stages, the number of back-mixing being equal to:

$$\frac{\tau\omega}{1.98}$$

when $\tau$ is the total residence time of fluid flowing through the drum and $\omega$ is the frequency of the concentration variation of the feed;

jet means for creating a jet stream of fluid at the inlet of each mixing stage;

baffle means positioned with respect to said jet means for reversing the flow of said jet stream of fluid whereby back-mixing of said fluid stream is promoted in each mixing stage, whereby the concentration variations in said fluid stream is dampened.

* * * * *